US006064895A

United States Patent [19]

Baumfalk et al.

[11] Patent Number: 6,064,895

[45] Date of Patent: May 16, 2000

[54] APPARATUS FOR FILTERING HIGH FREQUENCY SIGNALS

[75] Inventors: Arno Baumfalk, Sainerholz; Heinz Chaloupka, Bochum; Serguei Kolesov, Wuppertal, all of Germany

[73] Assignee: Robert Bosch GmbH, Stuttgart, Germany

[21] Appl. No.: 09/074,108

[22] Filed: May 7, 1998

[30] Foreign Application Priority Data

Jun. 4, 1997 [DE] Germany ..... 197 23 286

[51] Int. Cl.[7] ..... H01P 1/203; H01B 12/02

[52] U.S. Cl. ..... 505/210; 333/204; 333/219; 333/99 S

[58] Field of Search ..... 333/204, 219, 333/99 S; 505/210, 700, 701, 866

[56] References Cited

U.S. PATENT DOCUMENTS

| | | | |
|---|---|---|---|
| 4,727,342 | 2/1988 | Ishikawa et al. | 333/219.1 |
| 5,391,543 | 2/1995 | Higaki et al. | 333/99 S X |
| 5,710,105 | 1/1998 | Shen | 505/210 |

FOREIGN PATENT DOCUMENTS 44 36 295 A1 2/1996 Germany .

*Primary Examiner*—Benny T. Lee
*Attorney, Agent, or Firm*—Michael J. Striker

[57] ABSTRACT

The pass band filter has planar ring resonators arranged in pairs partly side-by-side and partly one above the other and a housing cover for each resonator. Each resonator includes a respective substrate provided with upper and lower conductive layers of high temperature superconductor material on respective opposite sides of the corresponding substrate, so that each planar ring resonator is operable in an edge-current-free TM010-oscillator mode. A respective coupling hole of radius $r_i$ is provided in the lower conductive layer (3) of each resonator and the lower conductive layers of both resonators in each pair face each other so that both resonators are coupled. Each housing cover has a respective truncated cone-shaped step ring (20) having a corresponding inner housing cover radius ($r_G$). The radius ratio $r_i/r_a$ ($r_a$ is the radius of the circular upper conductive layer) and the inner housing cover radius for each resonator are selected so that resonance frequencies of undesired oscillator modes of the resonators are shifted up to about 22% relative to the resonance frequency of the edge-current-free TM010-oscillator mode.

10 Claims, 9 Drawing Sheets

FIG. 1
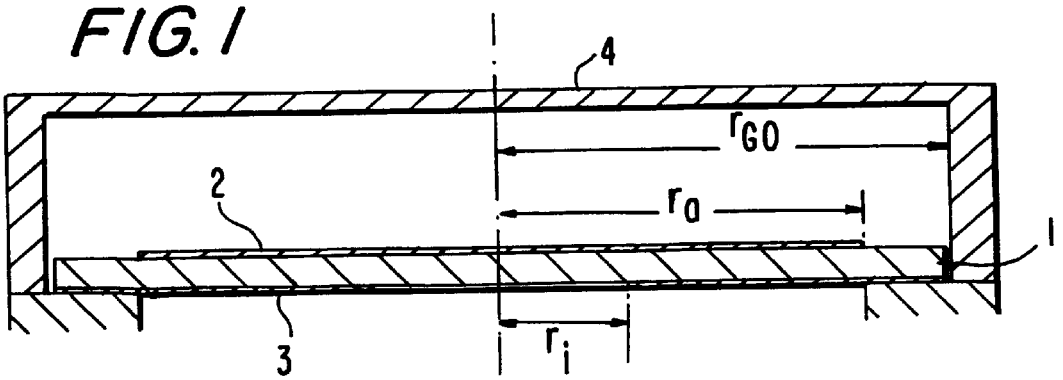
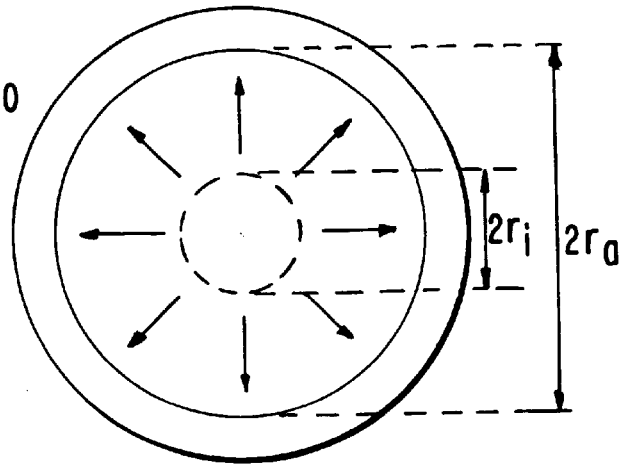
FIG. 2a
PRIOR ART
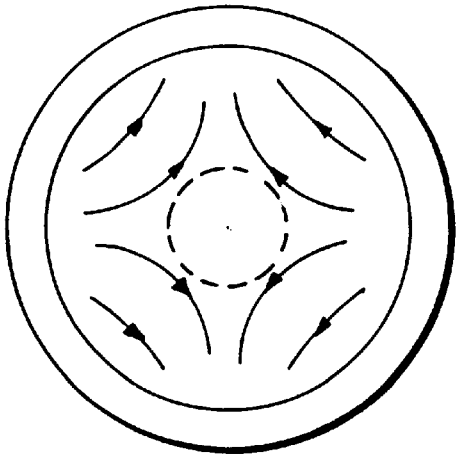
TM 210
FIG. 2b
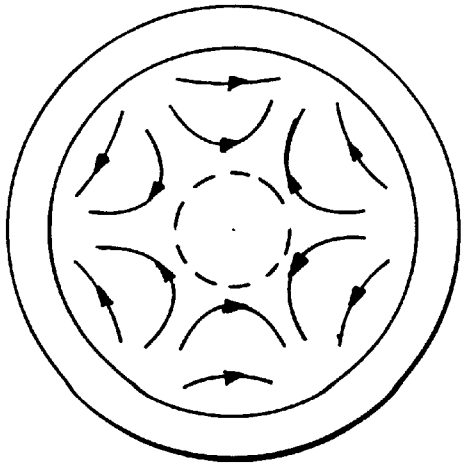
TM 310
FIG. 2c FIG. 3
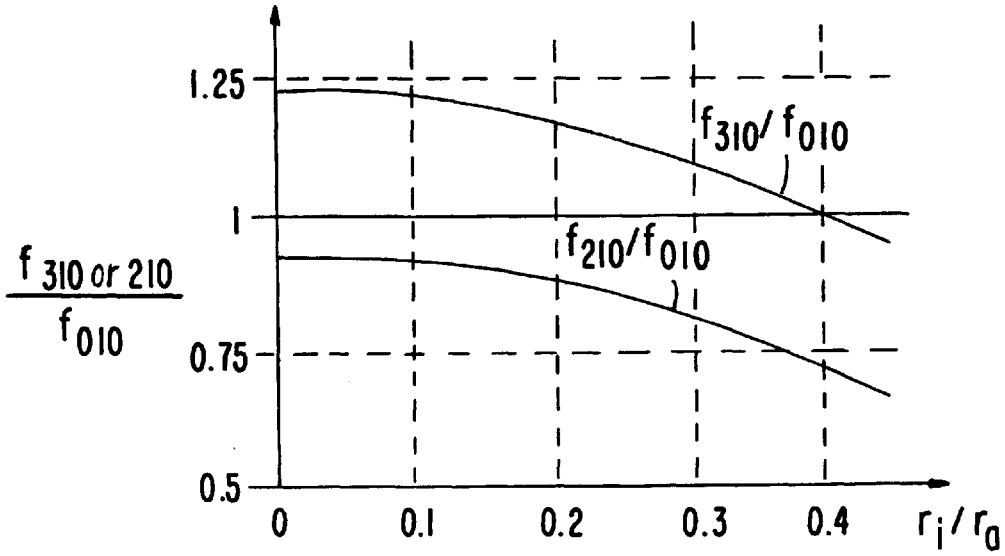
FIG. 4a
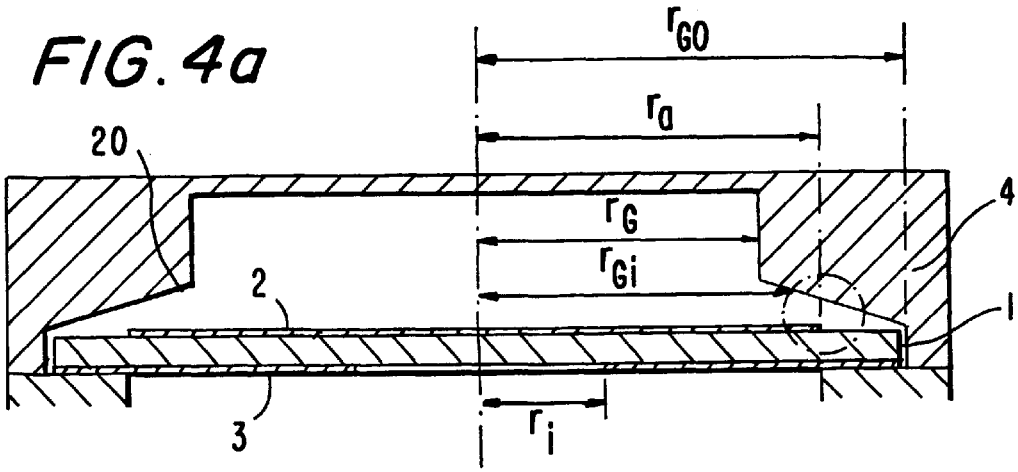
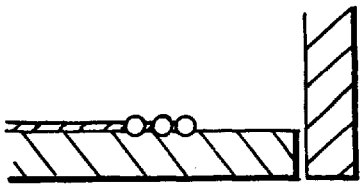
FIG. 4b
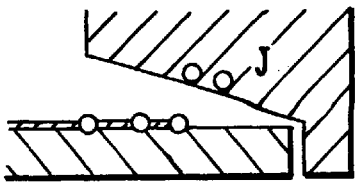
FIG. 4c FIG. 11a
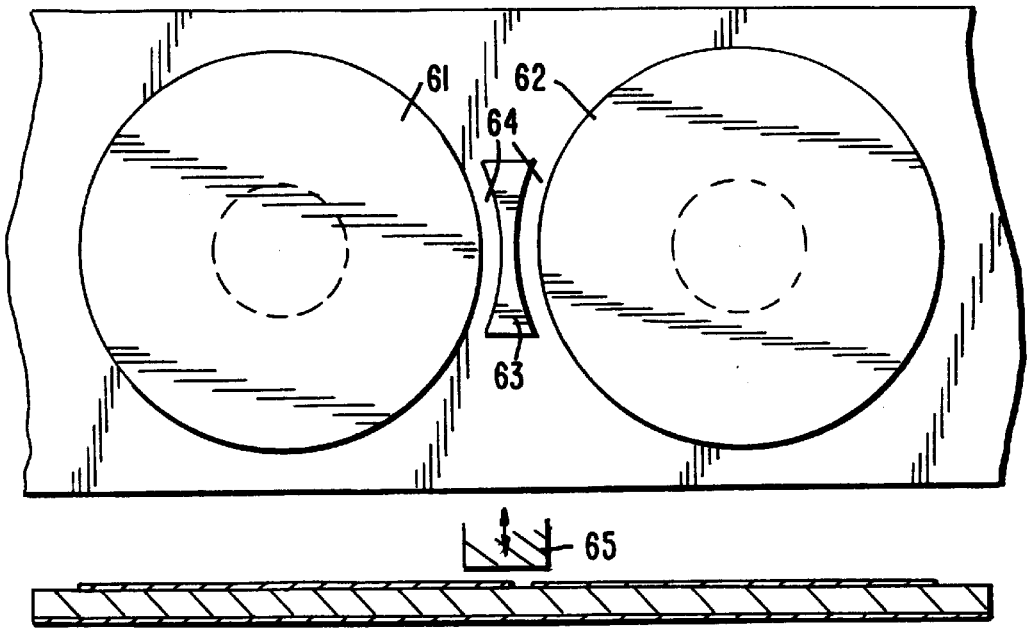
FIG. 11b
FIG. 12a
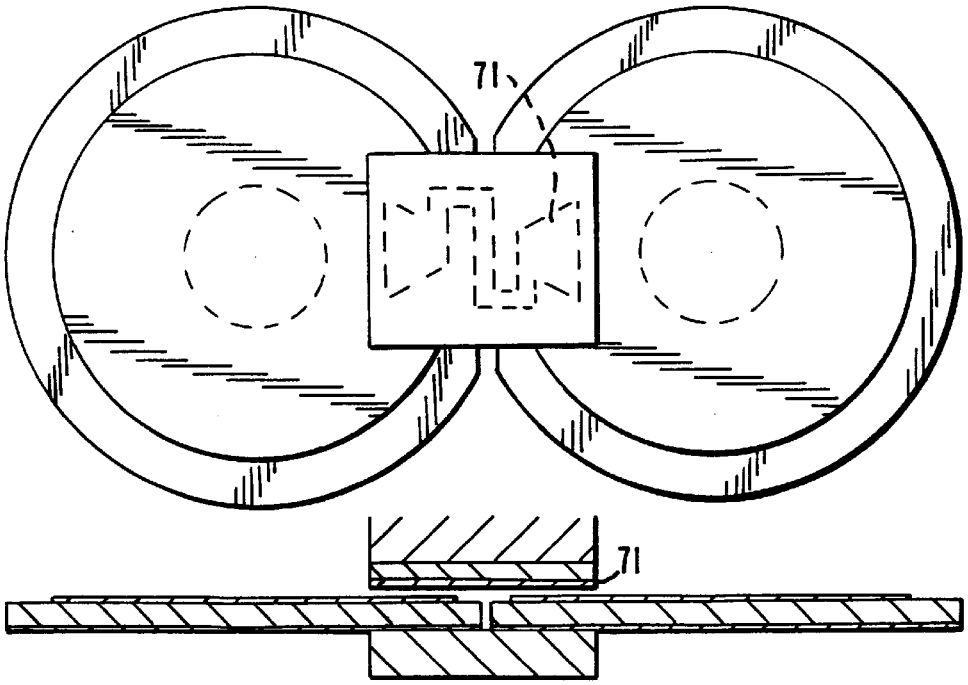
FIG. 12b

APPARATUS FOR FILTERING HIGH FREQUENCY SIGNALS

BACKGROUND OF THE INVENTION

The present invention relates to a useful pass band filter, which comprises a plurality of superconductor planar resonators and is suitable for use in high frequency communication and navigation systems.

Pass band filters are used in high frequency systems on the receiver side, e.g. as pre-selection filters and in the form of a filter bank for frequency channeling (input multiplexer). On the transmission side they form, e.g., elements of output multiplexers whose purpose is to provide the most loss-free transmission of amplified signals of the different frequency channels as possible to a common antenna.

These pass band filters are chiefly made from individual resonators that are coupled with each other coupled to and suitable feed lines. The function of the resonators in a pass band device is to provide an input of electromagnetic energy which is as loss-free as possible. The dissipation losses unavoidably connected with energy supply in resonators can be described quantitatively by the so-called non-load Q-factor. The non-load Q-factor, $Q_O$, of a resonator gives the ratio of the product of the average field energy W and the circuit resonance frequency $\omega_O$ to the dissipated power Pdiss:

$$Q_O=\omega_O W/P_{diss}.$$

Dissipation losses degrade the frequency transmission path through the pass band filter in comparison to an ideal loss-less pass-band filter so that the attenuation in the pass band range is increased and the pass band sides are "worn away". The smaller the relative bandwidth of the filter and the steeper its pass band sides, the greater this degrading effect of the dissipation losses is. Resonators of comparatively higher Q-factor, typically $Q_O>10000$, are required for filters with comparatively high specifications for pass band side steepness and relative bandwidth. The smaller the geometric dimensions of the individual resonators, the smaller the desired Q-factor, considering filters of different structural forms made from standard conductors, e.g. filters made from hollow resonators, from coupled coaxial resonators or from coupled planar microstrip resonators. Thus filters having high specifications must be made from relatively large hollow resonators.

Resonators can be made which have Q-factors up to about 200,000 and operate at operating temperatures of about 60 to 80 K by using cooled planar resonator structures with conductor strips made from high temperature superconductors on crystalline substrate materials and with substantially smaller geometric dimensions than conventional hollow resonators with Q-factors of about 20,000.

The use of planar resonators made from high temperature superconductors in filters for "high" operating powers is however limited by physical principles so that the superconductor properties of the currently known materials are degraded when the magnetic field strength of the high frequency field exceeds a value of about 50 A/cm at the surface of the superconductor film. This effect has proven to be especially disadvantageous in planar conducting structures, since a local field increase of about a factor of 10 occurs for current lines extending with their edges parallel because of magnetic field penetration at the edges of the conductors. The value of the maximum high frequency magnetic field strength is proportional to the square root of the field energy supplied to the resonator, which depends on the proportionality factor of the resonator shape and the oscillator type. Furthermore the field energy supplied per resonator is proportional to the throughput power of the filter and the characteristic value of the relative bandwidth.

The filter properties are already degraded because of the above-described effects using superconductor planar resonators with edge-parallel current flow lines in filters with a relative bandwidth on the order of about 0.3 to 2%, when the operating power exceeds a value of about 0.2 to 2 W.

One solution to the problem of the lower energy capacity of planar resonators made from a high temperature superconductor is disclosed in the invention described in German Patent Application DE 44 36 295 A1. The solution suggested there provides for use of a circular disk- or ring resonator, which is exited in a TM010-oscillator mode. Since no edge-parallel current flow lines occur, about a factor of 100 higher electromagnetic field energy can be fed to this resonator in comparison to a resonator of the same volume but with edge-parallel currents. For a filter with a bandwidth of about 0.3 to 2% a power compatibility of at least 20 to 200 W is achieved with this type of resonator.

Resonators comprising a crystalline substrate with a thin superconductor film grown on both sides are described in German Patent Application DE 44 36 295 A1. On one side designated the "front side" the superconductor layer is structured so that only one circular conductor surface or only one concentric ring-shaped conductor surface remains. On the other side, designated as the "rear side", the conducting layer extends up to the substrate edge. However circular or ring-shaped openings in the conducting layer for coupling purposes are provided on this rear side according to DE 44 36 295 A1. In this patent application a pass band filter is made from resonators arranged partially over each other and partially beside each other.

There are additional requirements for this type of pass band filter described in DE 44 36 295 A1 when it is used in output multiplexers (e.g. for communication satellites) which require solution of additional technical problems beyond those solved by the invention described in DE 44 36 295 A1. These technical problems and their solution are described here. The present invention at least partially results from the solution of these technical problems and is clearly distinguished in an outstanding manner from the state of the art.

In a case in which the pass band filters are used in an input or output multiplexer, different throughput frequencies are assigned to the individual filters that together determine the operating frequency range of the multiplexer. The typical relative bandwidth of an individual filter amounts to about 1%, while the entire operating frequency range has a typical width of about 20%. This means that substantially no degradation of the blocking properties in the entire frequency range above a pass band with a width of about 20% may occur for a filter with a bandwidth at the lower end of the operating frequency range. This frequency range is designated as the "operating blocking range" in the following discussion. In an analogous manner a pass band with a width of about 20% must be free of interference of the blocking properties for a filter with the pass band at the upper end of the operating frequency range.

All resonators have additional undesired oscillator modes ("interfering modes") at other frequencies in addition to the desired oscillator modes. The edge-current-free TM010-oscillator mode desired for operation of the filter does not represent a fundamental oscillator mode and thus there are both undesired oscillator modes with resonance frequencies above the resonance frequency of the TM010-mode and also undesired oscillator modes with resonance frequencies below the resonance frequency of the TM010-mode. The adjacent oscillator mode in the frequency range with a lower resonance frequency is the TM210-oscillator mode and the adjacent oscillator mode of higher frequency is the TM310-oscillator mode. The spacing of the resonance frequencies of these oscillator modes depends on several geometric parameters. The block properties of a filter are degraded when the resonance frequency of an undesired oscillator mode falls in the operating blocking range. No solution for these problems is described in German Patent Application DE 44 36 295 A1.

The required resonance frequencies and coupling factors between the individual resonators are derived from the specifications for the pass band filter to be constructed. In filter design these set values or desired values are converted into geometric structural parameters ("design values"). The filter resulting from this filter design process has however properties deviating from the desired frequency behavior because of approximations in the theoretical modeling and because of manufacturing tolerances and material variations. In filters with comparatively small bandwidth the filter must contain tuning elements which allow a subsequent fine correction ("trimming") of the filter parameters.

It is advantageous when the resonance frequencies of the individual resonators can be trimmed separately from each other, i.e. individually, and also when the coupling factors between the resonators are changeable by mechanical means. In the structure of the pass band filter proposed in German Patent Application DE 44 36 295 A1 all the front side of the planar resonators arranged over each other are oriented on the same side and the front side of a resonator under another resonator is coupled with the other resonator by coupling holes or coupling rings in the rear side of the other resonator. Dielectric tuning screws or other dielectric inserts are placed in the space between the two resonators so that a displacement of this dielectric insert causes an equalization of the resonance frequency of the resonator and the coupling factor.

In DE 44 36 295 A1 the coupling between the gates and resonators and the coupling of resonators beside each other is accomplished by the standard structures known in the art. This type of coupling can lead to a degradation of the Q-factor by dissipation losses in the coupling elements.

SUMMARY OF THE INVENTION

It is an object of the present invention to provide a filter apparatus for high frequency signals including planar superconductor resonators that has a configuration for the planar superconductor resonators and the surrounding normal conducting housing that allows a definite displacement or shift in the resonance frequencies of the undesired interfering oscillator modes relative to the resonance frequency of the desired TM010-oscillator mode and at the same time an independent tuning of the resonance frequencies of each individual resonator and the coupling between the resonators.

It is another object of the invention to provide a filter apparatus for high frequency signals in which couplings between connecting lines ("gates") and outer resonators are possible which do not degrade the quality factor of the resonators.

It is an additional object of the invention to provide an improved planar superconductor resonator especially suitable for a filter apparatus for high frequency signals.

These objects, and others which will be made more apparent hereinafter, are attained in a planar ring resonator comprising a substrate provided with upper and lower conductive layers on respective opposite sides of the substrate and a housing cover for the substrate with the conductive layers, each conductive layer comprising a superconductor material, preferably a high temperature superconductor material, so that the planar ring resonator is operable in an edge-current-free TM010-oscillator mode.

According to the invention the housing cover comprises a truncated cone-shaped step ring arranged above the substrate provided with the conductive layers, the step ring has a radius $r_{Gi}$ decreasing from a maximum value equal to the substrate radius $r_{G0}$ in the vicinity of or near the substrate with increasing distance from the substrate until at an inner housing cover radius $r_G$ and the upper conductive layer faces the housing cover.

The pass band filter according to the invention comprises a plurality of these planar ring resonators which are arranged so that resonance frequencies of each resonator and coupling factors between them are tunable independently of each other. The planar ring resonators are arranged partially one above the other and partially side-by-side in pairs in which the resonators are one above the other. In each pair the planar ring resonator comprises a substrate and upper and lower conductive layers made of high temperature superconductor material on respective opposite sides of the substrate, so that each planar ring resonator is operable in an edge-current-free TM010-oscillator mode. A coupling hole is provided in the lower conductive layer of each resonator and each resonator is arranged in each pair with the lower conductive layers facing each other. The coupling holes each have a coupling hole radius and the upper conductive layer has a conductive layer radius and each resonator has a housing cover having a truncated cone-shaped step ring having a housing cover radius, wherein the radius ratio of the coupling hole radius to the conductive layer radius, as well as the housing cover radius are selected for each resonator so that resonance frequencies of undesired oscillator modes of each resonator are shifted up to about 22% relative to a resonance frequency the edge-current-free TM010-oscillator mode.

According to the invention, the tuning of the coupling between two resonators of each pair largely independently of the tuning of the resonance frequencies is possible because the circular coupling holes with a radius $r_i$ are introduced in superconductor layers provided on the facing rear sides of the planar resonators which have a spacing d=0.5 to 2 mm from each other. Vacuum intervening spaces ("coupling volumes") through which the scattering field for coupling the resonators penetrates are arranged between the two resonators in each pair in the filter apparatus. Predetermined values of the respective coupling factors derived from the filter specifications are obtained by suitable selection of the spacing d and the coupling hole radius $r_i$. A reduction in the spacing d has the same effect as an increase in the size of the coupling hole radius $r_i$, so that an additional degree of freedom is provided for optimization. The subsequent tuning of the coupling factor ("trimming") is achieved by insertion of a loss-poor dielectric insert element in the coupling volume. The coupling factor may be changed by a lateral displacement of the dielectric insert relative to the coupling holes.

Vacuum-intervening spaces which are filled by the scattering field extending from the edges of the circular upper conductive layers are located between these high temperature superconductor layers of radius $r_a$ facing away from each other and the standard conducting housing parts. The individual resonance frequencies of the individual resonators thus may be tuned without acting on the coupling between them by using dielectric screws with mechanically changeable insertion depth.

An essential part of the invention concerns the possible shifting of the resonance frequencies of the undesired TM210- and TM310-oscillator modes relative to the frequency for the desired edge-current-free TM010-oscillator mode. The spacing of the resonance frequency of the TM210-oscillator mode from the resonance frequency of the desired mode can be increased from about 10% to about 25%, although the spacing of the resonance frequency of the TM310-oscillation mode is reduced from about 25% to almost 0% by increasing the radius ratio $r_i/r_a$ from about 0.1 to a value of about 0.4. Since, as mentioned above, an increase in the size of the coupling holes can be compensated for by increasing the spacing d while obtaining a predetermined coupling factor, freedom from interference modes under the bandwidth of up to about 22% is obtained for a filter whose bandwidth is close to the upper limit of the operating frequency range, when one uses comparatively large coupling holes. In contrast, however obtaining freedom from the interfering modes in a frequency range of about 22% width above the bandwidth of a filter whose bandwidth is close to the lower boundary of the operating frequency range is not possible by changing the coupling hole radius alone. This is because a reduction of the coupling hole radius ratio to values under about=0.12 would required values of the spacing d (typically<0.2 mm) that are so small that no dielectric insert could be introduced in the coupling volume arising and the desired value of the coupling could not possibly be obtained. At this point according to the invention the introduction of a truncated cone-shaped step ring in the part of the housing opposite to the front sides of the resonators allows a shift of the resonance frequencies of both undesired oscillator modes, i.e. the TM210- and TM310-oscillator modes, to higher values. Because of that, especially for a filter with a bandwidth range close to the lower edge of the operating frequency range, an interference mode-free range of about 22% above the bandwidth can be obtained, in spite of radius ratio values $r_i/r_a>0.12$ necessary for obtaining typical values of the coupling factor.

In order to obtain the advantage of the above-described arrangement of resonator pairs in a four-sector filter with quasi-elliptical properties, this four-sector filter can be formed from two filter pairs arranged beside each other in which the resonators beside each other are coupled by additional structures.

These structures can be made using high temperature superconductor material to avoid degradation of the quality factor by dissipation losses in the coupling structures between the respective first and last resonators and the connecting lines and coupling structures. For that reason the invention proposes to provide a microstrip conductor with superconducting conductor strips as the connecting lines, which are coupled with the resonators with a capacitive superconductor bridge, a superconductor structure with a slot-like coupling capacitor or are coupled galvanically. The coupling structures for the resonators side-by-side with each other can similarly be provided by a superconductor capacitor bridge or an arrangement with slot capacitor.

BRIEF DESCRIPTION OF THE DRAWING

The objects, features and advantages of the invention will now be illustrated in more detail with the aid of the following description of the preferred embodiments, with reference to the accompanying figures in which:

FIG. 1 is a schematic cross-sectional view through an individual superconductor ring resonator with a coupling hole in its lower conducting layer and a standard conducting housing of the prior art;

FIGS. 2*a*, 2*b* and 2*c* are respective diagrammatic views of current flow lines for the desired TM010-oscillator mode and the undesired TM210-and TM310-oscillator modes;

FIG. 3 is a graphical illustration of the dependence of the resonance frequencies $f_{210}$ and $f_{310}$ of the undesired oscillator modes relative to the resonance frequency $f_{010}$ of the desired oscillator modes on the radius ratio of the ring resonator;

FIG. 4*a* is a cross-sectional view through a planar ring resonator according to the invention having a resonator housing with a truncated cone-shaped step ring for influencing undesired oscillation modes;

FIG. 4*b* is a detailed cross-sectional view of an end portion of the planar ring resonator shown in FIG. 1 showing the current flow lines in the modes excited in the resonator;

FIG. 4*c* is a detailed cross-sectional view of an end portion of the planar ring resonator according to the invention shown in FIG. 4*a* showing the effect of the truncated cone shaped ring on the current flow lines in the modes excited in the resonator;

FIGS. 11*a* and 11*b* are respective top plan and side sectional views of another embodiment of a means for coupling two adjacent resonators of a pass band filter by means of a slot capacitor device; and FIGS. 12*a* and 12*b* are respective top plan and side sectional views of an additional embodiment of a means for coupling two adjacent resonators of a pass band filter by means of a device for rotation of the phase 180°.

DESCRIPTION OF THE PREFERRED EMBODIMENTS

Figure 5:
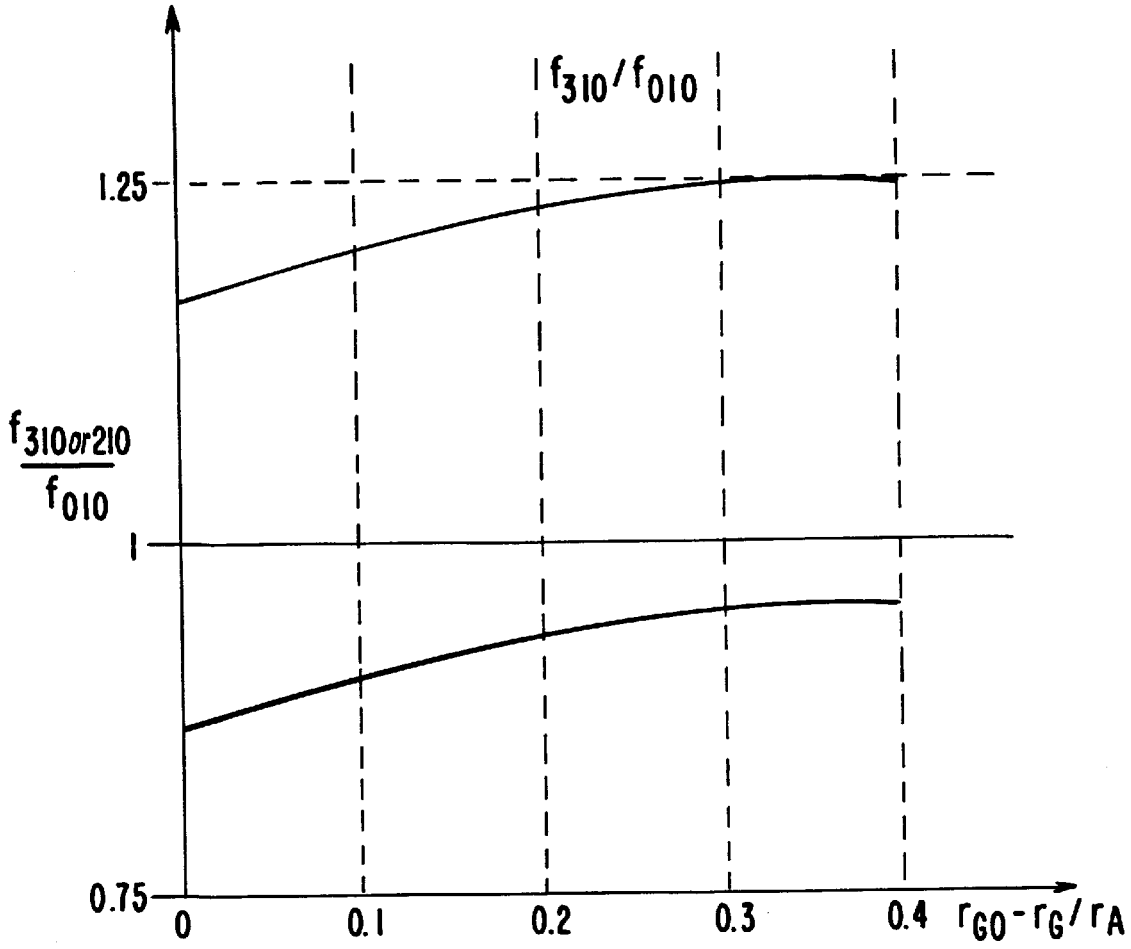
FIG. 5 is a graphical illustration of the dependence of the resonance frequencies $f_{210}$ and $f_{310}$ of the undesired oscillator modes relative to the resonance frequency $f_{010}$ of the desired oscillator mode on the diameter of the truncated cone-shaped step ring.

An individual superconductor resonator corresponding to the state of the art (German Patent Application DE 44 36 295

A1) is illustrated in FIG. 1 together with a housing 4. It comprises a circular crystalline substrate 1 of radius $r_{G0}$, e.g. made from lanthanum aluminate or sapphire, on both sides of which a superconductor structure made from a high temperature superconductor $YBa_2Cu_3O_{7-\delta}$ is applied, wherein the value of δ is selected to provide for high temperature superconductivity. The upper conductive layer 2 is circular with a radius $r_a$. The lower conductive layer 3 has a circular opening ("coupling hole") of radius $r_i$ for the purpose of coupling with a second resonator arranged under it (which is not shown in FIG. 1). The resonator is provided with a housing cover 4 for the purposes of electromagnetic shielding, which, e.g., may have a cylindrical form as shown in FIG. 1 and can be made from standard conducting material, e.g. copper.

According to German Patent Application DE 44 36 295 A1 the TM010-oscillator mode of the ring resonator is used for the pass band filter. All current flow lines extend in a radial direction in this oscillator mode according to FIG. 2*a*. Since no edge-parallel current flow lines exist, excessive current densities at the edges can not occur by the previously mentioned current penetration effects. About 100 times the electromagnetic field energy can be supplied without degrading the superconductor properties of this edge-current-free superconductor resonator in comparison to the electromagnetic filed energy supplied to an edge-current containing superconductor resonator of approximately the same volume.

Besides the desired TM010 oscillator mode having the resonance frequency $f_{010}$ depending on both radii $r_i$ and $r_a$ (see FIG. 1) or both diameters $2r_i$ and $2r_a$ (see FIG. 2*a*) additional oscillator modes with a current flow line distribution which differs from that of the desired oscillator modes exist. Also the resonance frequencies of the undesired frequency modes are different from the resonance frequency $f_{010}$ of the desired TM010 oscillator mode. It is necessary that either the resonance frequency of all the undesired oscillator modes be outside of the operating frequency range or that it is at least guaranteed that these oscillator mode types are not excited for the interference-free operation of a filter bank, e.g. the filter bank of an output multiplexer. Since suppression of the excitation is hardly practical, all the resonance frequencies of the undesired oscillator modes must be outside the operating frequency range. In the case of resonators with $r_i/r_a<0.4$ the oscillator mode with the next lower resonance frequency is the TM210-oscillator mode and the oscillator mode with the next higher resonance frequency is the TM310-mode as shown in FIGS. 2*b* and 2*c* which shows the current flow lines in these modes.

The invention described here allows the variation of the resonance frequencies of the TM210- and TM310-oscillator modes relative to that of the desired mode so that an undesired resonance occurs in none of the filters in a filter bank with filters of different bandwidth in an operating frequency range up to typically 22% band width.

The dependence of the resonance frequencies on the radius ratio $r_i/r_a$ (wherein $r_i$ and $r_a$ have the same meaning as described previously in connection with FIGS. 1, 2*a* and 4*a*) shown in FIG. 3 provides a starting point for the solution of the invention. It is apparent that with small coupling holes ($r_i/r_a$—small) the resonance frequency of the TM310-mode is about 26% above the resonance frequency $f_{310}$ of the desired oscillator mode, in contrast to the resonance frequency $f_{210}$ of the TM210-mode that is only about 12% below that resonance frequency. The resonance frequency of the TM310-oscillator mode is always more than that of the desired oscillator mode with coupling holes of increased size, while the resonance frequency of the TM210-mode is smaller and shifted up to about 26%. If the ratio of the radii can be varied without referral to other requirements between small values of about 0.05 to about 0.4, a multiplexer with a bandwidth of about 22% can be produced, since resonators with very small coupling holes can be used for a filter in a lower frequency range and resonators with very large coupling holes can be used for a filter in a higher frequency range. Since the coupling holes cannot however be selected arbitrarily small to obtain the sufficient coupling to the adjacent resonators, this possibility alone does not suffice for relative shifting of the resonance frequencies.

The above-described problem is solved by the special structure of the housing shown in FIGS. 4*a* to 4*c* according to the claims appended hereinbelow. The housing cover 4 is provided with a truncated-cone-shaped step ring 20 having an inner housing cover radius $r_G$. The step ring 20 has an interior radius $r_{Gi}$ which decreases from a maximum value equal to the substrate radius $r_{G0}$ with increasing distance from the upper conductor strip 2 on the substrate 1 until at the inner housing cover radius $r_G$. This housing structure differs from the structure shown in FIG. 1. As shown in FIG. 4*c* current J flows opposing the edge-parallel current flows (shown with circles with internal x's in FIGS. 4*b* and 4*c*) in the undesired TM210- and TM310 are induced in the edge-adjacent part of the wall of the truncated-cone-shaped step ring 20, which act on the current flow line directions in these undesired modes so that the current flow lines are shifted toward the interior of the resonator. Because of that the effective diameter of the ring for the TM210- and T310-oscillator modes is smaller and the resonance frequency of these modes is higher. FIG. 5 shows that the resonance frequencies of the undesired modes can be shifted to higher values by increasing the size of the truncated-cone-shaped step ring, i.e. increasing the size of $r_{G0}$ - $r_G$ wherein $r_{G0}$ is the substrate radius and $r_G$ is the inner housing cover radius, i.e. the inner radius of the housing cover in a cylindrical cavity portion shown in FIG. 4*a* above the substrate with the upper conductive layer 2. A multiplexer with a typical bandwidth of up to 22% can be produced by combining the possible resonance frequency shift by changing the size of the truncated-cone-shaped step ring with the resonance frequency shift by selection of the radius ratio $r_i/r_a$ within certain limits:

$$\{r_i/r_a\}_{min}<\{r_i/r_a\}<\{r_i/r_a\}_{max}.$$

Since the interfering mode currents are only excited in the standard conducting truncated-cone-shaped wall of the housing, one obtains substantially no degradation of the quality factor of the desired oscillator modes.

The remaining parts of the resonator shown in FIG. 4*a* are similar to those shown in FIG. 1: upper conductive layer 2 and lower conductive layer 3 with the coupling hole of radius $r_i$ are provided on opposite sides of the substrate 1. The resonator of FIG. 4*a* is provided with the housing cover 4 with the distinguishing truncated-cone-shaped step ring 20 as previously mentioned.

Figure 6:
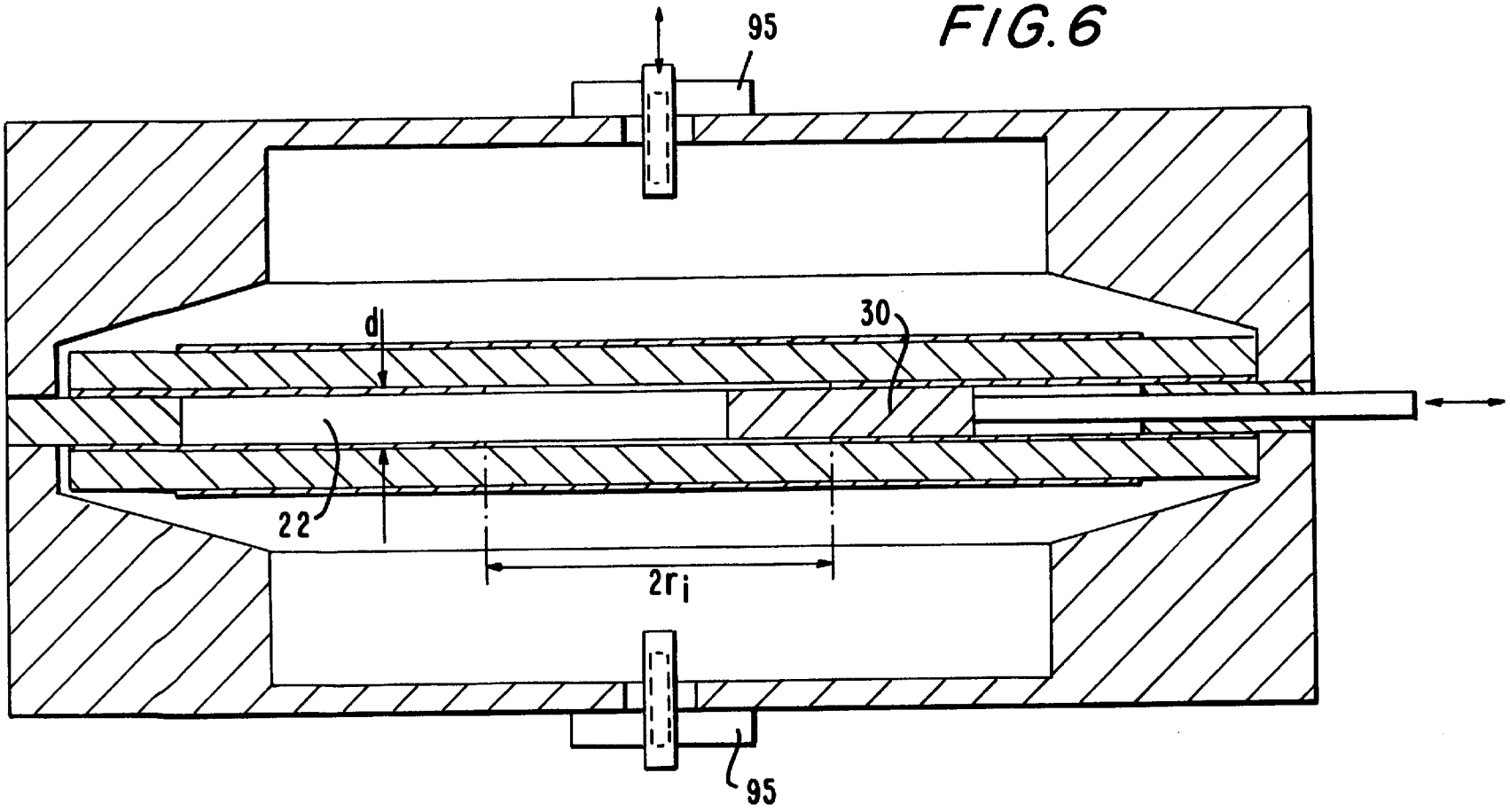
FIG. 6 is a cross-sectional view through a two-sector pass band filter made from two ring resonators with mechanically tunable coupling between both resonators.

A pass band filter can be made from a plurality of ring resonators electromagnetically coupled with each other. FIG. 6 shows a pass band filter comprising two resonators arranged over each other. The two superconductor ring resonators are provided in a housing so that both coupler holes of diameter $2r_i$ are spaced a predetermined distance d>0 opposite from each other. Thus a structure is produced with differences in the following regions:

a) the individual resonator regions which comprise substrate material bounded by superconductor conducting surfaces: the electromagnetic field energy is largely supplied to these spatial regions;

b) both vacuum regions between the planar resonators and the standard conducting housing covers: the electromagnetic leakage fields of the resonators are located therein; and c) the "coupling region" between both ring resonators: the electromagnetic leakage field of the resonators which couples both resonators is located here.

The required resonance frequencies of the ring resonator and the required values for the "coupling factor" between both resonators are derived from the respective specifications for the pass band filter. Both radii $r_i$ and $r_a$ for the ring resonator, the distance between the resonators and the dimensions of the truncated-cone-shaped step ring in the housing cover are essential parameters for this structure. These parameters may be determined from the desired resonance frequencies and the desired coupling factors and from the requirement that the resonance frequencies of the undesired modes are sufficiently spaced from the resonance frequency of the desired mode. This pre-dimensioning of the filter structure generally involves errors or unconsidered factors that require that the final fine tuning be performed by mechanical means. A greater advantage of the structure shown in FIG. 6 is that the resonance frequencies of both individual resonators and the coupling factors can be trimmed nearly independently of each other.

The coupling factors between the resonators may be, e.g., changed by insertion of a dielectric insert 30 between the resonators from the side in the coupling region 22. By changing the position of this dielectric insert 30 relative to the position of the coupling holes the coupling factor may be changed. The smaller the spacing of the center of the dielectric insert from the center of the coupling hole, the larger will be the coupling factor.

The resonance frequencies of each ring resonator may be influenced independently of each other, since a tuning screw 95, advantageously a dielectric tuning screw, may be inserted to varying depths into the region between the resonator and the cover with small losses.

Figure 7A:
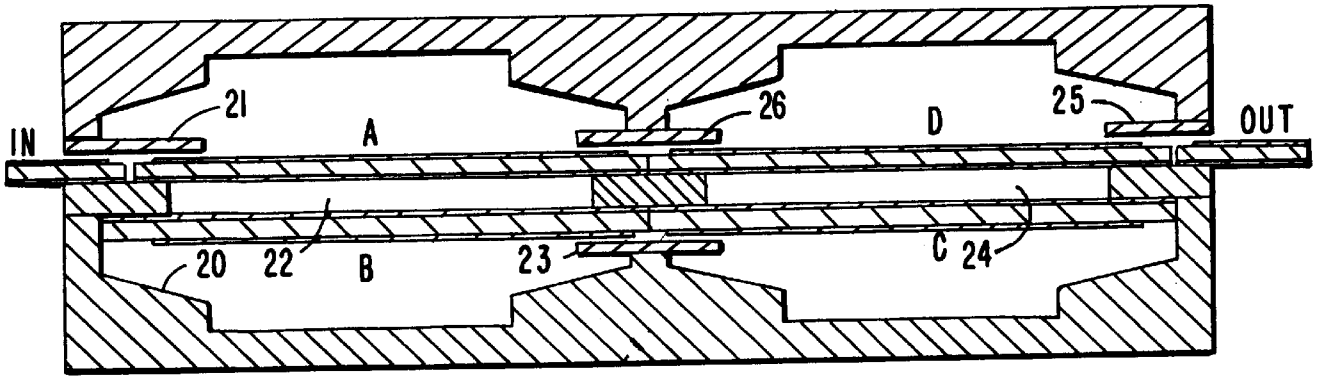
FIGS. 7*a* and 7*b* are diagrammatic cross-sectional views through a four-section pass band filter with quasi-elliptical frequency characteristics made from four superconductor ring resonators and a circuit diagram for the four-section pass band filter respectively.
Figure 7B:
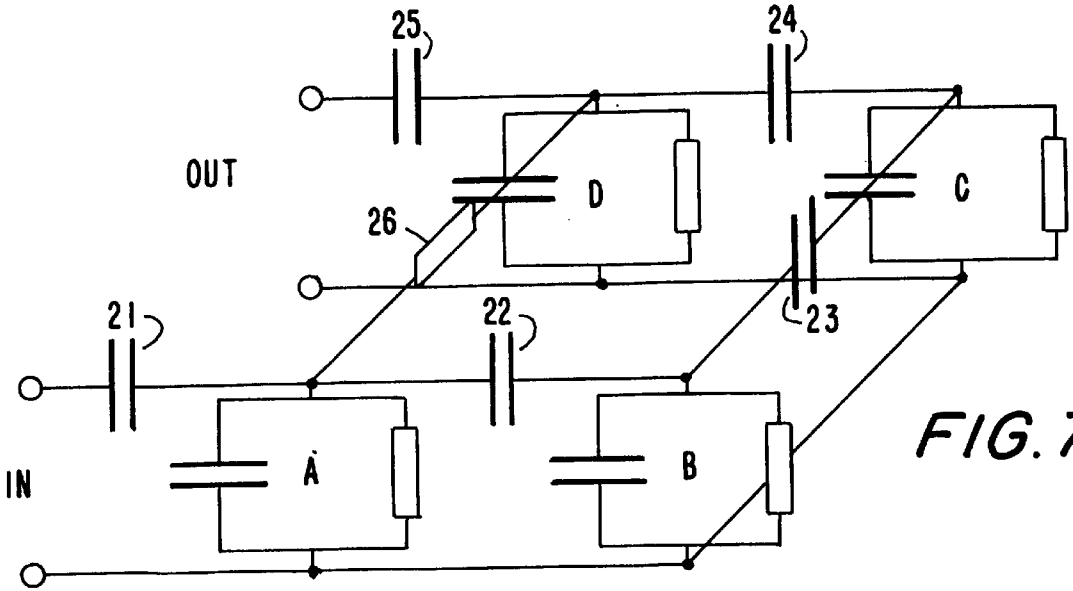

Pass bands, which e.g. are used in output multiplexers of broadcasting satellites, are typically formed from 4 to 5 coupled resonators. FIGS. 7*a* and 7*b* schematically shows a possible structure for a 4-sector pass band filter (4-resonator). This 4-sector pass band filter arises because 2 pairs of resonators are arranged next to each other. The input gate "in" is coupled by the coupling device 21 with the ring resonator A. The ring resonator B is coupled with resonator A by both coupling holes and the coupling volume 22. Details of this coupling between A and B are seen in FIG. 6. Coupling of the resonator B to the resonator C occurs, e.g. by a capacitive "cross-coupling" 23. The coupling between resonator C and D corresponds to that between A and B. The resonator D is connected to the output gate "out" by the coupling device 25. The resonators A and B are also coupled to obtain a quasi-elliptical frequency behavior for the filter, advantageously by an inductive coupling 26. In FIG. 7*b* a schematic circuit diagram for this type of pass band filter is shown in which the labeling of circuit elements agrees with the labeling of individual components in FIG. 7*a* and are not further described herein.

Figure 8A:
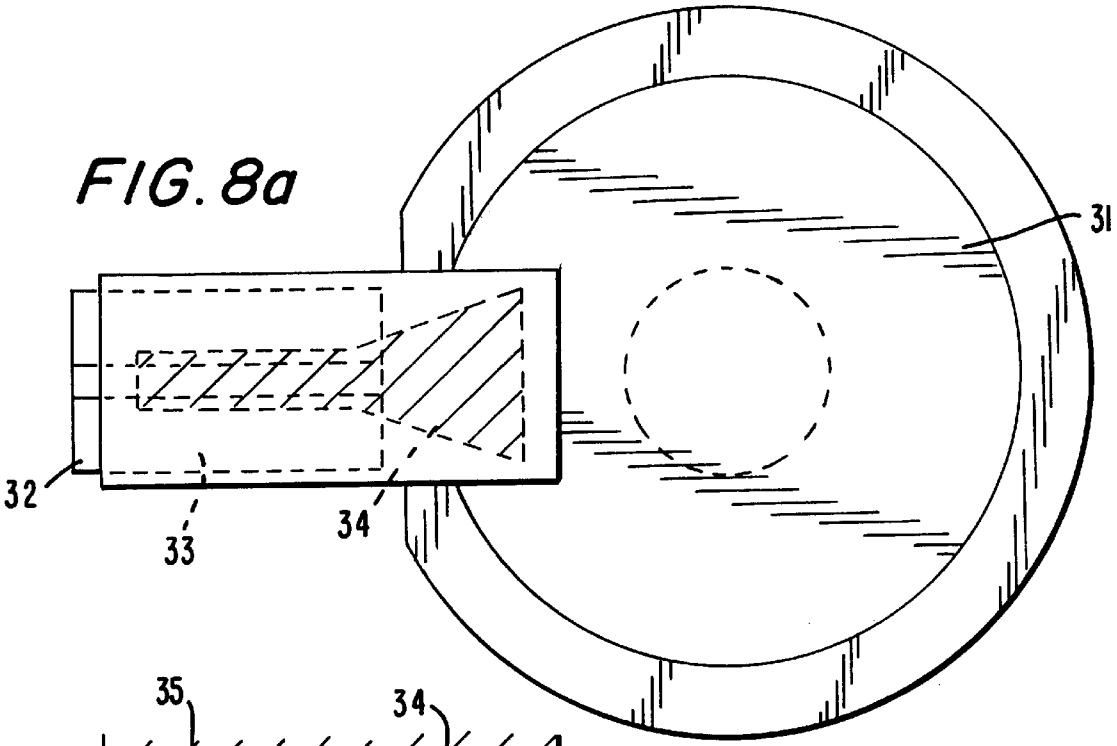
FIGS. 8*a* and 8*b* are respectively a top plan view and a side sectional view of a means for coupling of the outer resonator of a pass band filter to the gate with a capacitor bridge device.
Figure 8B:
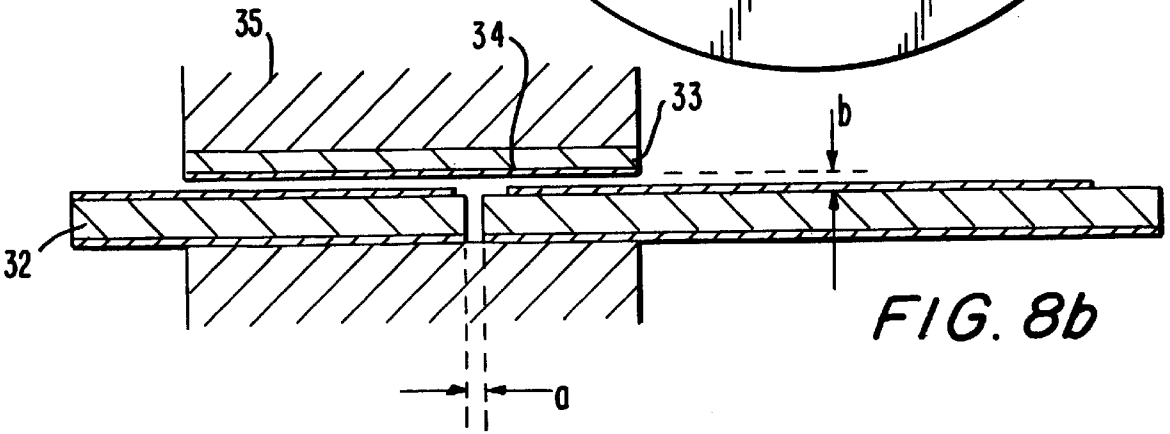

FIGS. 8*a* and 8*b* show the structure of one possible embodiment of the coupling devices 21 and 25 shown in FIGS. 7*a* and 7*b*. These coupling devices perform the connection between the gates and the first and/or last resonator of the pass band structure. A microstrip conductor 32 is arranged beside the ring resonator 31 in the embodiment of this coupling device shown in FIGS. 8*a* and 8*b*. The substrates of the ring resonator and the microstrip conductor 32 can abut laterally against each other, or a "gap" of width a can exist between both substrates as shown in FIG. 8*b*. The "capacitor bridge" shown in FIGS. 8*a* and 8*b* provides a sufficient coupling between the microstrip conductor and the ring resonator. It comprises a conductor strip 34 on a substrate 33. The substrate can be mounted on a part 35 of the housing. The conductor strip 34 as shown in FIGS. 8*a* and 8*b* can comprise a homogeneous conductor strip piece and an enlarged piece. The conductor strip can however be homogeneous over its entire length. The strength of the coupling can be changed by variation of the distance b (see FIG. 8*b*) between the conductor strip 34 of the capacitor bridge and the conductor strip of the ring resonator 31 or by variation of the distance a between the substrate of the ring resonator and the substrate of the microstrip conductor. The capacitor bridge and the strip line of the microstrip conductor are made from a high temperature superconductor material to advantageously avoid degradation of the quality factor of the resonator by losses in the coupling device next to the conductor strip of the resonator.

Figure 9A:
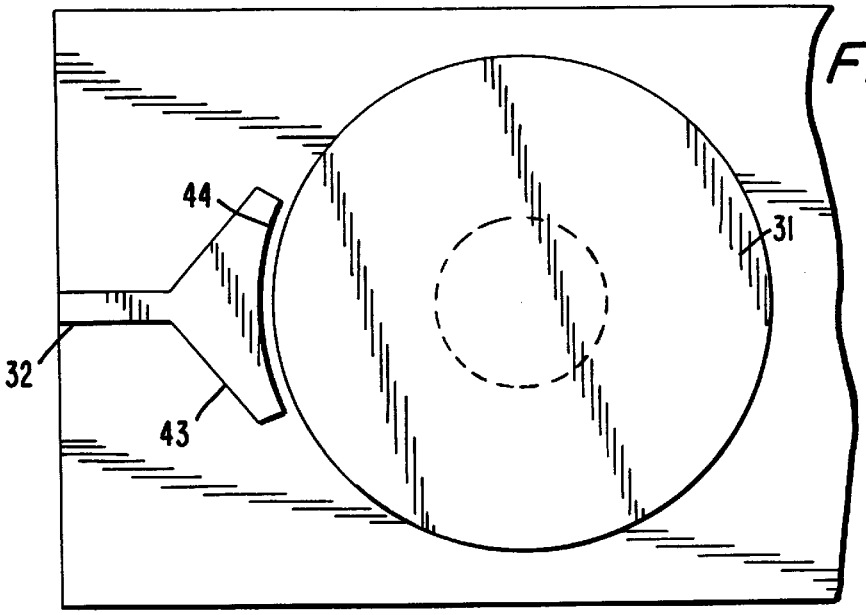
FIGS. 9*a* and 9*b* are top plan and side sectional views of another embodiment of a means for coupling of the outer resonator of a pass band filter to the gate with a slot capacitor device.
Figure 9B:
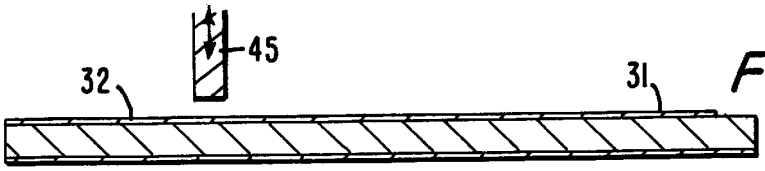
Figure 9C:
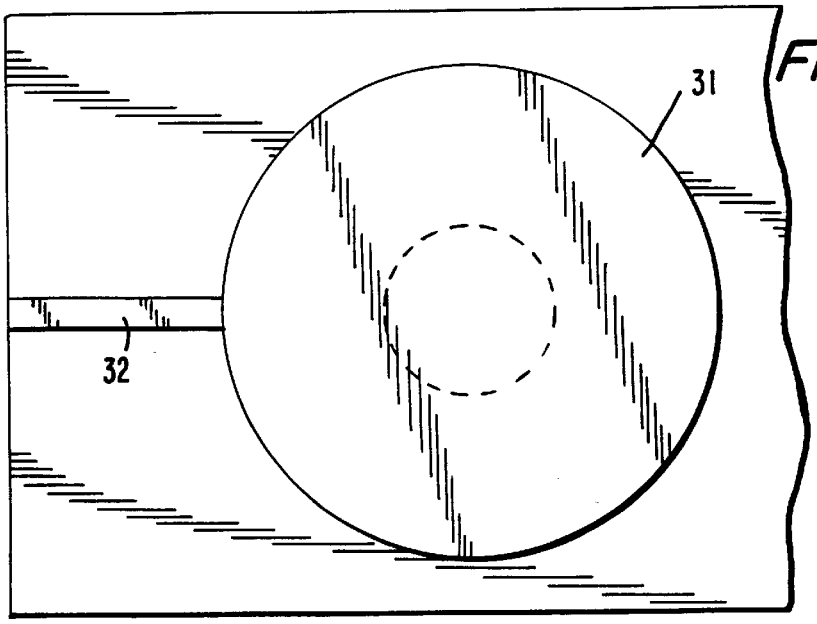
FIGS. 9*c* and 9*d* are top plan and side sectional views of an additional embodiment of a means for coupling of the outer resonator of a pass band filter to the gate with a galvanic device.
Figure 9D:
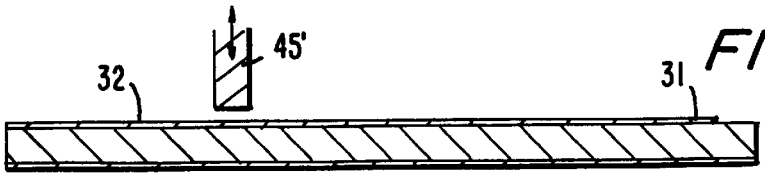

Alternatively to the embodiment of FIGS. 8*a* and 8*b* the coupling device can be provided on the same substrate as the ring resonator as shown in FIG. 9*a* through 9*d*. FIGS. 9*a* and 9*b* show one possible embodiment of this type, while FIGS. 9*c* and 9*d* show another possible embodiment.

In the embodiment of FIGS. 9*a* and 9*b* the microstrip conductor 32 is formed with a "fin" 43 (see FIG. 9*a*) so that a slot capacitor 44 (see FIG. 9*a*) comprising the fin and the opposing edge portion of the ring resonator results. The dimensions of the slot are selected so that the coupling factor corresponds to the value associated with the respective filter specifications. Subsequent changes (trimming) of the values of the coupling factor could be performed with a dielectric screw 45 as shown in FIGS. 9*a* and 9*b*.

The strip line 32 of the microstrip conductor can be galvanically connected with the edge of the ring resonator 31 in the manner shown in the coupling device of FIGS. 9*c* and 9*d* alternatively to the embodiment shown in FIGS. 9*a* and 9*b*. A subsequent change ("trimming") of the coupling factor can happen by moving a "dielectric piston" 45' into the region of connection between the strip line and the resonator edge as seen in FIG. 9*d*.

Figure 10A:
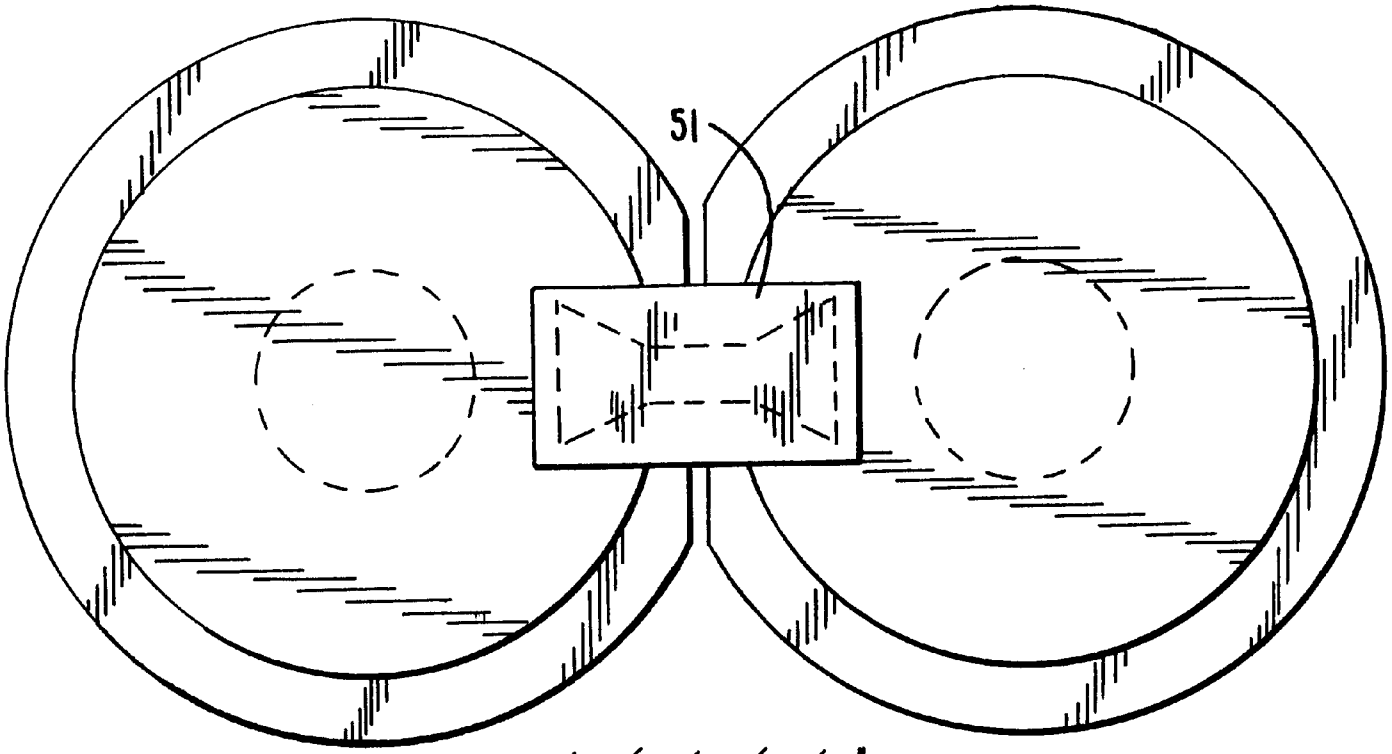
FIGS. 10*a* and 10*b* are respective top plan and side sectional views of a means for coupling two adjacent resonators of a pass band filter by means of a capacitor bridge device.
Figure 10B:
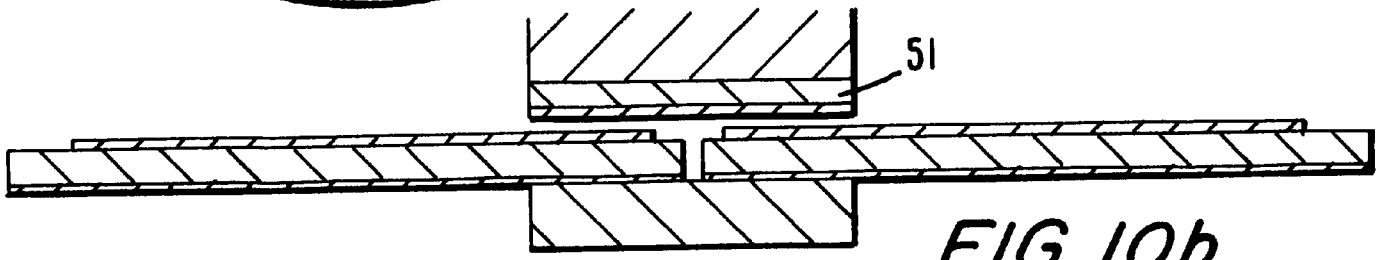

As shown in FIG. 7*a* a capacitive cross-coupling (23 in FIG. 7*a*) requires the both resonators be in a side-by-side relationship. This cross-coupling 51 can be provided between both resonators shown in FIGS. 10*a* and 10*b* as a capacitor bridge.

An embodiment according to FIGS. 11*a* and 11*b* can be used to couple side-by-side resonators on a common substrate alternatively to the capacitor bridge between two resonators arranged side-by-side as shown in FIG. 10. In this embodiment the coupling device between both ring resonators 61 and 62 comprises a conductor segment 63 and two slot capacitors 64. The trimming of the coupling is possible with a tuning screw 65 as seen in FIG. 11*b*.

An inductive over-coupling between resonators A and D (26 in FIG. 7*a*) produces a pass band having quasi-elliptical frequency behavior (damping poles at the end frequencies) as shown in FIG. 7*a*. FIG. 12 shows another embodiment of this type of inductive over-coupling. Here the 180° phase rotation required relative to the capacitive coupling is accomplished by a meandering-shaped conducting piece 71 of suitable length.

The disclosure of German Patent Application 197 23 286.8 of Jun. 4, 1997 is hereby explicitly incorporated by reference. This German Patent Application discloses the same invention as described herein and claimed in the claims appended hereinbelow and is the basis for a claim of priority for the instant invention under 35 U.S.C. 119.

While the invention has been illustrated and described as embodied in an apparatus for filtering high frequency signals, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

We claim:

1. A planar ring resonator comprising a circular substrate (1) having a substrate radius ($r_{G0}$), upper and lower conductive layers (2,3) on respective opposite sides of said substrate and a housing cover (4) for said circular substrate provided with said conductive layers, said conductive layers comprising a high temperature superconductor material; and wherein said housing cover (4) comprises a truncated cone-shaped step ring (20) arranged above said substrate provided with the conductive layers, said step ring (20) has a radius ($r_{Gi}$) decreasing from a maximum value with increasing distance from said substrate until at an inner housing cover radius ($r_G$), said maximum value being equal to said substrate radius ($r_{G0}$) in the vicinity of said substrate, and said upper conductive layer (2) faces said housing cover (4).

2. The planar ring resonator as defined in claim 1, further comprising a tuning element (45,45',65) movably mounted on said housing cover (4) so as to be movable to and from the conductive layers.

3. A pass band filter comprising a plurality of planar ring resonators and a housing cover for each of said resonators dispersed and arranged so that resonance frequencies of each of said resonators and coupling factors between said resonators are tunable independently of each other;

wherein said planar ring resonators are arranged partially one above the other and partially side-by-side in pairs of said resonators and said resonators of each of said pairs are arranged one above the other;

wherein each of said planar ring resonators comprises a respective substrate and upper and lower conductive layers on respective opposite sides of the corresponding substrate, each of said conductive layers comprising a high temperature superconductor material so that each of said planar ring resonators is operable in an edge-current-free TM010-oscillator mode;

wherein a respective coupling hole is provided in the lower conductive layer of each of said resonators, said resonators of each of said pairs are arranged with said lower conductive layers thereof facing each other, said coupling holes each have a respective coupling hole radius ($r_i$), said upper conductive layers each have a respective upper conductive layer radius ($r_a$) and said respective housing cover for each of said resonators comprises a respective truncated cone-shaped step ring having a corresponding inner housing cover radius ($r_G$);

wherein a radius ratio of the coupling hole radius to the upper conductive layer radius, as well as the inner housing cover radius, for each of said resonators are selected so that resonance frequencies of undesired oscillator modes of each of the resonators are shifted up to about 22% relative to a resonance frequency of said edge-current-free TM010-oscillator mode.

4. The pass band filter as defined in claim 3, wherein the respective coupling hole radius of each of said resonators of each of said pairs and a respective spacing between said lower conductive layers of said resonators of each of said pairs are selected to obtain corresponding predetermined coupling factors for coupling between said resonators of each of said pairs and corresponding leakage fields between said resonators of each of said pairs.

5. The pass band filter as defined in claim 4, further comprising a respective dielectric insert movable through and in a coupling space provided between said resonators of each of said pairs and corresponding means for adjusting a position of said respective dielectric insert in said coupling space of each of said pairs to trim said predetermined coupling factors.

6. The pass band filter as defined in claim 3, further comprising respective connecting lines electrically connected to said upper conductive layer of each of said resonators, said connecting lines being arranged on said substrate in each of said resonators for input and output of electromagnetic energy, and wherein said connecting lines consist of superconductor microstrip lines.

7. The pass band filter as defined in claim 6, wherein said respective connecting lines are electrically connected to said corresponding upper conductive layer via a respective capacitive coupling by means of a corresponding meandering conductor strip.

8. The pass band filter as defined in claim 6, wherein said respective connecting lines are electrically connected to said corresponding upper conductive layer via a respective galvanic connection.

9. The pass band filter as defined in claim 6, wherein said respective connecting lines are electrically connected to said corresponding upper conductive layer via a respective capacitor bridge.

10. The pass band filter as defined in claim 6, wherein said respective connecting lines are electrically connected to said corresponding upper conductive layer via a respective slot capacitor.

* * * * *